United States Patent [19]

Hanson

[11] 4,090,859

[45] May 23, 1978

[54] DUAL-DISPLACER TWO-STAGE SPLIT CYCLE COOLER

[75] Inventor: Charles M. Hanson, Springfield, Va.

[73] Assignee: The United States of America as represented by the Secretary of the Army, Washington, D.C.

[21] Appl. No.: 780,375

[22] Filed: Mar. 23, 1977

[51] Int. Cl.[2] ..... F25B 9/00

[52] U.S. Cl. ..... 62/6

[58] Field of Search ..... 62/6

[56] References Cited

U.S. PATENT DOCUMENTS

| | | | |
|---|---|---|---|
| 3,218,815 | 11/1965 | Chellis et al. | 62/6 |
| 3,220,201 | 11/1965 | Heuchling et al. | 62/6 |
| 3,552,120 | 1/1971 | Beale | 62/6 |
| 3,774,405 | 11/1973 | Leo | 62/6 |
| 3,991,585 | 11/1976 | Mulder | 62/6 |

FOREIGN PATENT DOCUMENTS

| | | | |
|---|---|---|---|
| 185,940 | 10/1960 | U.S.S.R. | 62/6 |

*Primary Examiner*—Lloyd L. King

*Attorney, Agent, or Firm*—Nathan Edelberg; Max L. Harwell; Robert P. Gibson

[57] ABSTRACT

A split cycle cooler having two free moving in-line regenerator-displacers, one within the other in which the one functions to produce a precooled volume for the other, wherein both are controlled by two pneumatic pistons operating against two pneumatic spring volumes. The device provides refrigeration of small heat loads to cryogenic temperatures.

4 Claims, 1 Drawing Figure

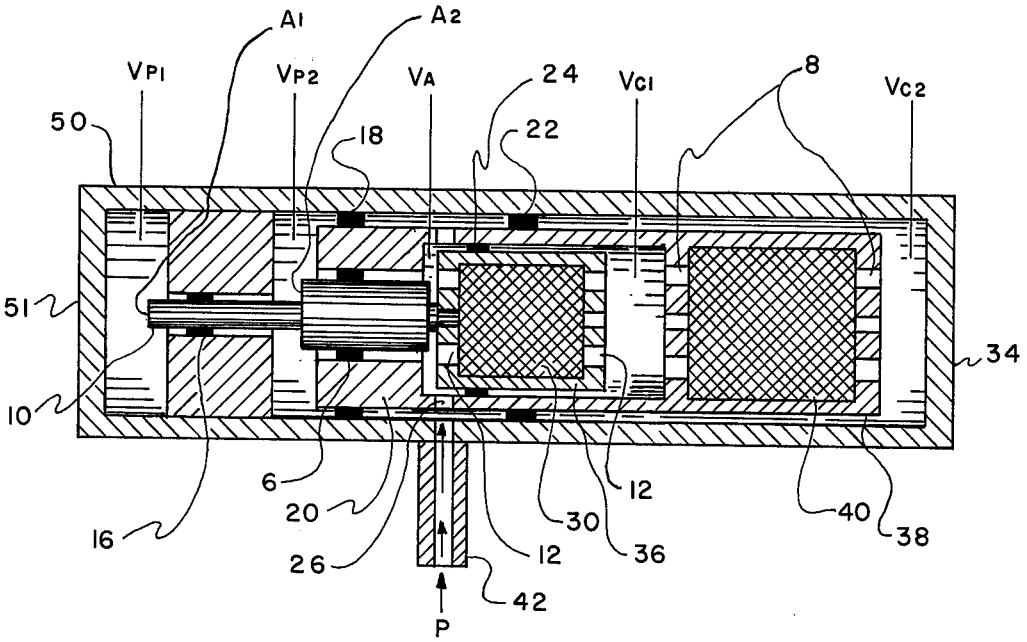
A1
A2
VP1
VP2
VA
24
VC1
8
VC2
50
18
22
51
34
10
6
20
26
16
12
30
36
12
40
38
42
P

DUAL-DISPLACER TWO-STAGE SPLIT CYCLE COOLER

The invention described herein may be manufactured, used, and licensed by the U.S. Government for governmental purposes without the payment of any royalties thereon.

BACKGROUND OF THE INVENTION

Other known two stage coolers have mechanical links from the regenerator-displacers to a crankshaft for moving the displacers. Work has to be expended in driving the two stages, or in driving one displacer wherein the other displacer moves freely due to pressure waves caused by action from the one driven displacer. Further, the use of two stage driven displacers sometimes requires a stepped profile of the cold finger.

SUMMARY OF THE INVENTION

The present invention comprises a free moving dual in-line regenerator-displacer two-stage split cycle cooler cold finger for providing a refrigerated surface to small heat loads in a closed cycle cryogenic cooler. The device is enclosed by a cooler housing having a cold end and a pneumatic spring volume end, which pneumatic spring volume end being comprised of first and second pneumatic spring volumes, with a working volume between the cold end and the pneumatic spring volume end. The working volume has an inlet port connected to a compressor means which produces alternating pressure waves in a working fluid.

The free moving dual in-line regenerator-displacers are comprised of a first, or inner, stage displacer and a second, or outer, stage displacer wherein said inner stage displacer has a first pneumatic piston extending into the first pneumatic spring volume at one end and a first stage regenerator matrix extending into a precooled volume and said outer stage displacer has a second pneumatic piston extending into the second pneumatic spring volume at one end and a second stage regenerator matrix extending into a cold volume at the cold end of the cooler.

The alternating pressure waves of the working fluid which are introduced into the working volume have an average pressure that is equal to the average pressure in said first and second pneumatic spring volumes and therefore the high pressure portion of the alternating pressure waves causes the working fluid to flow through both the first and second regenerator matrices and to move both the first and second stage regenerator-displacers toward the pneumatic spring volume end of the cooler housing to provide cooling in the precooled volume and even more cooling in the cold volume. Conversely, the low pressure portion of the alternating pressure waves causes the comparatively much increased pneumatic spring volume pressure to move both the first and second stage regenerator-displacers back toward the cold end, causing heating in the precooled and cold volumes but at less of a rate than the heat removed by the cooling cycle thereof during the expansion cycle when more work was being done by virtue of the higher pressure. The result is that there is net cooling in the precooled and cold volumes.

IN THE DRAWING

The lone FIGURE illustrates the present invention in cross-section.

DETAILS OF THE PREFERRED EMBODIMENT

The present split cycle cooler cold finger is illustrated as being comprised of the two cooler stages enclosed in cooler housing 50. An inlet connection 42 is connected to a remote compressor means (not shown) which provides alternating pressure waves P of some light gas, such as helium, directly into ambient working volume VA through inlet port 26. These pressure waves may be assumed to be sinusoidal in shape but are not limited thereto. A pneumatic spring volume end 51 of the cooler housing 50 is comprised of a first pneumatic spring volume VP1 and a second pneumatic spring volume VP2 that have relatively constant pressures therein, which pressures are approximately the average pressure of sinusoidal pressure waves P.

During the high pressure portion of wave P as indicated by arrow heads in the FIGURE, the light gas flows first through the first stage regenerator matrix 30 of the first stage regenerator-displacer 36 by way of first stage displacer pores 12 to a precooled volume VC1 and on through the second stage regenerator matrix 40 of the second stage regenerator-displacer 38 by way of second stage displacer pores 8 to a cold volume VC2. Cold volume VC2 is the final cooling volume at cold end 34 of the cold finger. The cooling of the working gas within precooled volume VC1 causes the gas that enters the second stage regenerator-displacer 38, directly from volume VC1, to initially be cooler than otherwise would be the case of a one stage regenerator. Volume VC1 is precooled during the high pressure portion of waves P because of the transfer of heat to regenerator matrix 30. Likewise regenerator matrix 40 further absorbs heat from volume VC1 during the high pressure portion of waves P to cause volume VC2 to become colder. Therefore, cold volume VC2 may be driven to a lower temperature than could be possible in a one stage regenerator device. Assume that at the beginning of the high pressure cycle, both regenerator-displacers 36 and 38 are at the far right of the lone FIGURE so that volumes VC1 and VC2 are near zero. The high pressure cycle of waves P causes the first stage regenerator-displacer 36 to move to the left before the second stage regenerator-displacer 38 begins to move to the left. Volumes VP1 and VP2 control motion of the first stage regenerator-displacer 36 by means of the pressure differences across first stage pneumatic piston 10 areas A1 and A2 and clearance seals 6 and 16, between the working volume VA and VP2 and between the working volume VA and VP1. Similarly, motion of the second stage regenerator-displacer 38 is controlled by pressure difference across second stage pneumatic piston 20 and clearance seal 18. The two areas of the first pneumatic piston 10, represented as A1 projecting into volume VP1 and A2 projecting into volume VP2, the diameters of second pneumatic piston 20, the sizes of precooled volume VC1 and 2nd cold volume VC2, the friction of seals 6, 16, and 18, and the masses of the regenerator-displacers 36 and 38 may all be manufactured so that a given pressure in the working volume VA produces an acceleration of the first stage regenerator-displacer 36 that is about twice that of the second stage regenerator-displacer 38. The acceleration of 36 is preferably twice that of 38 in both the expansion and contraction phases of volumes VC1 and VC2 since the most efficient cooling is accomplished at those speeds.

The enlarged area A2 of the first pneumatic piston causes the direct force of the high pressure portion of waves P to be diminished, thus allowing the movement of 36 to be mostly caused by the increasing pressure in volume VC1 acting on 36 simultaneously with the flow of the working fluid through the pores 8 and the regenerator matrix 40 of 38 but prior to the increasing pressure in volume VC2 that causes movement of 38 to expand to volume of VC2. The heat removed from volumes VC1 and VC2 is transferred to working volume VA at ambient temperature. During the low pressure portion of waves P, motion of 36 and 38 is reversed, and therefore heat is transferred from VA to VC1 and VC2. However, since this part of the cycle occurs at low pressure, the transfer of heat is less than during the high pressure portion, and thus there is net cooling of VC1 and VC2 and net heating of VA.

Even though the preferred embodiment has been presented wherein the first stage displacer 36 moves at twice the speed of the second stage displacer 38 and phasing of the movement of 36 and 38 is entirely by their free displacement caused by the alternating pressure waves P, variations of this embodiment may be implemented. For example, control of movement and phasing of 36 and 38 may be implemented by connecting a pressure line through a pressure drop device to one of the pneumatic volumes VP1 and VP2, and/or attaching to the other pneumatic volume a pressure which is out of phase with the first pressure. Also, the device may be simplified at the expense of stroke, or movement, control of 36 and 38 by omitting pneumatic volume VP1 wherein pistons 10 and 20 would then share a common pneumatic volume. Relative phasing could then be accomplished by different diameters of pistons 10 and 20 and possibly a secondary alternating pressure wave.

A further variation could be accomplished by increasing the area A2 of piston 10 to the point that the high pressure portion of waves P on piston 20 is too small to cause 20 to move but any increase in waves P causes only inner displacer 36 to move to the left until it hits the rear of displacer 38 in the volume VA and then carries 38 from the time that VC1 is at a maximum until VC2 reaches a maximum. This difference in phasing between displacers 36 and 38 is small compared to the pressure-volume phase differences due to the speed with which 36 and 38 move.

I claim:

1. A free moving in-line dual-displacer two-stage split cycle cooler cold finger for providing refrigeration of small heat loads in a closed cycle cryogenic cooler, said device comprising:

a cooler housing comprising a pneumatic spring volume end isolated by seals from a cold end and further comprising a working volume having an inlet port in a center portion that is connected by a closed system of working fluid to a remote compressor means for providing alternate high and low pressure waves in said working fluid to said cold end; and a dual-displacer in said cold end comprised of a first stage regenerator-displacer having internal heat storage means with accessible pores thereto and a first stage pneumatic piston at the working volume end that moveably extends through said seals into said pneumatic spring volume end and a second stage regenerator-displacer having internal heat storage means with accessible pores thereto and a second stage pneumatic piston that encloses said first stage regenerator-displacer and moveably extends through said seals into said pneumatic spring volume end in which a precooled volume is established between said first stage and second stage regenerator-displacers and a cold volume is established between said second stage regenerator-displacer and said cold end wherein the average pressure of said alternating pressure waves in said working fluid is equal to the average pressure in said pneumatic spring volume end wherein said high pressure waves expand said precooled volume prior to expanding said cold volume due to the larger differential pressure in said high pressure waves than the pressure in said pneumatic spring volume and said low pressure waves cause compression of said precooled volume prior to compression of said cold volume due to the larger differential pressure in said pneumatic spring volume than the low pressure waves wherein more total heat is transferred from said cold end by removing heat to both of said first and second stage internal heat storage means during the higher work input of said high pressure waves than is transferred back to said precooled and cold volumes during the low work input low pressure waves of said alternating pressure waves to provide said free moving in-line dual-displacer two-stage split cycle cooler cold finger at said cold end.

2. A cold finger as set forth in claim 1 wherein said pneumatic spring volume end is comprised of a first pneumatic spring volume and a second pneumatic spring volume providing an average pressure on said first pneumatic piston with said second pneumatic spring volume providing an average pressure on said second pneumatic piston.

3. A cold finger as set forth in claim 2 wherein said internal heat storage means is a first stage regenerator-displacer matrix and a second stage regenerator-displacer matrix wherein these matrices are comprised of some loosely packed heat absorbant, low heat conductivity material.

4. A cold finger as set forth in claim 3 wherein said first stage regenerator-displacer moves at about twice the speed of said second stage regenerator-displacer in both the expansion and compression cycles.

* * * * *